US005512403A

United States Patent [19]

Tyagi et al.

[11] Patent Number: 5,512,403

[45] Date of Patent: Apr. 30, 1996

[54] MIXTURE OF CARRIER PARTICLES USEFUL IN ELECTROGRAPHIC DEVELOPERS

[75] Inventors: Dinesh Tyagi, Fairport; William E. Yoerger, Rochester, both of N.Y.

[73] Assignee: Eastman Kodak Company, Rochester, N.Y.

[21] Appl. No.: 286,854

[22] Filed: Aug. 5, 1994

[51] Int. Cl.[6] ..... G03G 9/107; G03G 9/113

[52] U.S. Cl. ..... 430/106.6; 430/108; 430/137

[58] Field of Search ..... 430/106.6, 108, 430/137

[56] References Cited

U.S. PATENT DOCUMENTS

| | | | |
|---|---|---|---|
| 3,438,773 | 4/1969 | Hayashi et al. . | |
| 3,598,648 | 8/1971 | Hayashi et al. | 430/122 |
| 3,607,342 | 9/1971 | Sato et al. | 430/121 |
| 3,795,617 | 3/1974 | McCabe | 430/108 |
| 3,795,618 | 3/1974 | Kasper | 430/108 |
| 3,796,664 | 3/1974 | Hayashi et al. | 430/108 |
| 3,838,054 | 9/1974 | Trachtenberg et al. | 430/108 |
| 3,898,170 | 8/1975 | Kasper | 430/108 |
| 3,970,571 | 7/1976 | Olson et al. | 430/137 |
| 4,233,387 | 11/1980 | Mammino et al. | 430/137 |
| 4,297,427 | 10/1981 | Williams et al. | 430/108 |
| 4,590,140 | 5/1986 | Mitsuhashi et al. | 430/102 |
| 4,678,734 | 7/1987 | Laing et al. | 430/137 |
| 4,725,521 | 2/1988 | Shigeta et al. | 430/108 |
| 4,868,083 | 9/1989 | Nagatsuka et al. | 430/108 |
| 4,902,597 | 2/1990 | Takeda et al. | 430/106.6 |
| 4,929,528 | 5/1990 | Shinoki et al. | 430/108 |
| 4,937,166 | 6/1990 | Creatura et al. | 430/108 |
| 5,336,579 | 8/1994 | Zimmer et al. | 430/108 X |

FOREIGN PATENT DOCUMENTS

| | | |
|---|---|---|
| 431968-14518 | 6/1968 | Japan . |
| 2135366 | 5/1990 | Japan . |
| 2168273 | 6/1990 | Japan . |
| 1204861 | 9/1970 | United Kingdom . |

*Primary Examiner*—Roland Martin
*Attorney, Agent, or Firm*—Anne B. Kiernan

[57] ABSTRACT

The invention provides a mixture of coated carrier particles suitable for use in dry electrographic developer wherein each of the types of carrier particles occupies a position in the triboelectric continuum different from the position of the other type and the level of charge to which the mixture of carrier particles charges the toner in a developer continuously increases or decreases between a high level in which said mixture comprises all of one type of carrier particles to a low level in which said mixture comprises all of the other type of carrier particles.

This type of carrier provides a simple way to adjust the charge on the toner provided by the carrier, that is, more of one of the types of carrier particles in the mixture can be added to the toner to either increase or decrease the charge on the toner.

20 Claims, No Drawings

MIXTURE OF CARRIER PARTICLES USEFUL IN ELECTROGRAPHIC DEVELOPERS

FIELD OF THE INVENTION

This invention relates to carrier particles which are mixed with electrographic toner particles to form electrographic developers. More particularly, the invention concerns mixtures of two types of carrier particles to achieve optimum levels of toner charge.

BACKGROUND

In electrostatography an image comprising a pattern of electrostatic potential (also referred to as an electrostatic latent image) is formed on an insulative surface by any of various methods. For example, the electrostatic latent image may be formed electrophotographically (i.e., by imagewise radiation-induced discharge of a uniform potential previously formed on a surface of an electrophotographic element comprising at least a photoconductive layer and an electrically conductive substrate), or it may be formed by dielectric recording (i.e., by direct electrical formation of a pattern of electrostatic potential on a surface of a dielectric material). Typically, the electrostatic latent image is then developed into a toner image by contacting the latent image with an electrographic developer. If desired, the latent image can be transferred to another surface before development.

One well-known type of electrographic developer comprises a dry mixture of toner particles and carrier particles. Developers of this type are commonly employed in well-known electrographic development processes such as cascade development and magnetic brush development. The particles in such developers are formulated such that the toner particles and carrier particles occupy different positions in the triboelectric continuum, so that when they contact each other during mixing to form the developer, they become triboelectrically charged, with the toner particles acquiring a charge of one polarity and the carrier particles acquiring a charge of the opposite polarity. These opposite charges attract each other such that the toner particles adhere to the surfaces of the carrier particles. When the developer is brought into contact with the electrostatic latent image, the electrostatic forces of the latent image (sometimes in combination with an additional applied field) attract the toner particles, and the toner particles are pulled away from the carrier particles and become electrostatically attached imagewise to the latent image-bearing surface. The resultant toner image can then be fixed in place on the surface by application of heat or other known methods (depending upon the nature of the surface and of the toner image) or can be transferred to another surface, to which it then can be similarly fixed.

A number of requirements are implicit in such development schemes. Namely, the electrostatic attraction between the toner and carrier particles must be strong enough to keep the toner particles held to the surfaces of the carrier particles while the developer is being transported to and brought into contact with the latent image, but when that contact occurs, the electrostatic attraction between the toner particles and the latent image must be even stronger, so that the toner particles are thereby pulled away from the carrier particles and deposited in the desired amount on the latent image-bearing surface. In order to meet these requirements for proper development, the level of electrostatic charge on the toner and carrier particles should be maintained within an acceptable range. The actual range of charge level that is acceptable or optimum depends upon the nature of the particular toner, carrier, development process, and development apparatus desired to be employed.

Toner particles in dry developers often contain material referred to as a charge agent or charge-control agent, which helps to establish and maintain toner charge within an acceptable range. Many types of charge-control agents have been used and are described in the published patent literature. The level of charge on toner particles can be controlled to some extent by changing either the nature or the amount of the charge agent in the toner particles. However, there are difficulties and limits associated with such approaches. In changing the nature of the charge agent, one must be concerned with the availability of an appropriate charge agent material and with its compatibility, dispersability, and possibility of adverse reaction with the toner or carrier material. In changing the amount of charge agent in toner particles, one often finds that decreasing the amount leads to increased undesirable throw-off of material from the developer during use or that in increasing the amount a limit or plateau is reached in the capability of dispersing the charge agent in the toner particles. Also when the amount of charge agent in the toner is increased above an optimum amount, the charge to mass of the toner decreases. When the amount of charge agent in the toner is decreased below an optimum amount, the charging rate of the toner is decreased.

Therefore, the level of charge that will be created and maintained on the toner is still very dependent on the nature and condition of the carrier particles.

One known method of controlling charge level of a toner involves base or acid washing of the carrier. This technique allows some control of toner charge level but is not very attractive from a manufacturing standpoint and provides little leeway for precise adjustment of charge level.

Many known dry electrostatographic developers contain thermoplastic toner particles and carrier particles that comprise a core material coated with a polymer. Such polymeric carrier coatings can serve a number of known purposes. One such purpose can be to aid the developer to meet the electrostatic force requirements mentioned above by shifting the carrier particles to a position in the triboelectric series different from that of the uncoated carrier core material, in order to adjust the degree of triboelectric charging of both the carrier and toner particles. Another purpose can be to reduce the frictional characteristics of the carrier particles in order to improve developer flow properties. Still another purpose can be to reduce the surface hardness of the carrier particles so that they are less likely to break apart during use and less likely to abrade surfaces (e.g., photoconductive element surfaces) that they contact during use. Yet another purpose can be to reduce the tendency of toner material or other developer additives to become undesirably permanently adhered to carrier surfaces during developer use (often referred to as scumming). A further purpose can be to alter the electrical resistance of the carrier particles.

However, while such carrier coatings can serve the above-noted purposes well, in some cases they do not adequately serve some or all of those purposes simultaneously. For example, depending upon the nature of the toner particles and carrier core material desired to be included in the developer, such carrier coatings can cause the developer to acquire a triboelectric charge that is at an inappropriate level for optimum developer performance.

Some publications describe means for alleviating this problem to some degree by blending polymers or other materials having triboelectric characteristics different from each other and coating the blend on carrier core particles in order to alter the carrier particles' triboelectric charging characteristics more precisely and, in some cases, provide other desirable properties, such as better adhesion of the coating to the core particles. Many different types of polymers have been described as useful for this purpose. See, for example, U.S. Pat. Nos. 4,937,166; 4,725,521; 4,590,440; 4,297,427; and 5,100,754. By altering the ratio of the amounts of materials included in the blend, one can fairly precisely alter the level of triboelectric charge imparted to the carrier particles and to the toner particles with which they are intended to be mixed.

However, such an approach also has drawbacks and limitations. In choosing materials having different triboelectric characteristics to be blended and coated on carrier core particles, one must be concerned with compatibility of the materials. There must not be adverse interaction of the materials with each other that would alter their desired triboelectric charging tendencies. Also, if the materials are not miscible with each other it will not be possible to blend the materials homogeneously, which can result in poor coating adhesion and mechanical integrity and inconsistent triboelectric properties. Furthermore, if the melting temperatures of the materials are significantly different, it will be difficult or impossible to properly coat the blend on core particles by well known melt-coating techniques. Also, because the materials must be blended, only one method of coating the blended materials simultaneously on the cores can be used.

Another drawback inherent in such an approach is that if it is desired to alter the triboelectric charging tendencies of carrier particles coated with a blend, by adjusting the ratio of the amounts of different materials in the blend (e.g., in response to developer aging or to a change in toner material, development process, and/or development apparatus), a new coated carrier must be produced, having an altered ratio of amounts of materials in the coated blend, each time it is desired to effect such a change in charging tendency.

One patent, U.S. Pat. Nos. 3,795,618 discloses the use of a mixture of two different carrier particles to affect the amount of toner charge; however, the toner charge does not either continuously increase (or decrease) with an increase (or decrease) in the weight percent of one of the carriers in the mixture. Therefore, it would not be possible to knowingly increase or decrease the toner charge by adding one type of carrier particles to the mixture without first determining what the exact composition of carriers is in the mixture, or by doing it by trial and error.

Thus, a need still exists for carrier mixtures which avoid the above-noted drawbacks associated with using one type of carrier particle comprising core particles coated with a blend of different materials, i.e., while avoiding the need to be concerned with the compatibility, solubility, miscibility, and matching melting temperatures of materials in blends. Also, a need exists for convenient means for changing the level of toner charge without having to fashion a new type of carrier particle each time it is desired to effect such a change.

SUMMARY OF THE INVENTION

The invention provides a mixture of carrier particles useful in electrographic developers. Developers consist of a toner and carrier particles. The carrier mixture comprises at least two types of carrier particles, wherein one of the types of carrier particles occupies a position in the triboelectric continuum different from the position in the triboelectric continuum of the other type and the level of charge to which the mixture of carrier particles charges a toner continuously increases or decreases between one level where a mixture has all of one type of carrier particles to a different level where the mixture has all of the other type of carrier particles. "Continuously increasing" or "continuously decreasing" means that the graph of charge to mass of the toner versus the concentrations of the carrier particles in the carrier mixture either always has a negative or positive slope allowing for an error margin of 10% due to limitations in scientific measuring accuracy. The term triboelectric continuum is the scale containing positive and negative charge values upon which the charge acquired by carrier particles falls when the carrier particles are charged up against toner particles. Where the carrier particles fall on the triboelectric continuum is a function of the toner particles that the carrier particles contact.

Thus, it has been found that a precise level of electrostatic charge can be imparted to toner particles by these inventive mixtures of different carrier particles, while advantageously avoiding the need to be concerned with the compatibility, solubility, miscibility, and melting temperatures of materials blended together in coatings on carrier particles such as taught in the prior art.

Furthermore, the present invention provides a convenient method for changing the level of triboelectric charge imparted to toner particles by carrier particles, without having to fashion a new type of carrier particle. The carrier particle mixtures of this invention make it possible to knowingly increase or decrease the toner charge in a developer without knowing the composition of the carrier mixture. This is accomplished by adding one type of carrier particles to a carrier particle mixture, which type of carrier particle added depends on whether an increase or decrease in the toner charge is desired. Thus, by using two or more different types of carrier particles which occupy different positions on the triboelectric continuum and which possess a continuously increasing or decreasing relationship between the composition of the mixture and the charge on the toner and adjusting the ratio of their respective amounts in a mixture, one can impart to toner particles a level of charge anywhere between the two different levels of charge that would have been imparted by each of the types of carrier particles alone.

This method for changing the level of the toner charge can be used when formulating a new developer composition or when adjusting the toner charge of a developer during use, for example, in an electrostatographic machine.

DESCRIPTION OF PREFERRED EMBODIMENTS

It has been found that a mixture of carrier particles of this invention can be employed in an electrographic developer to impart a uniform level of electrostatic charge to toner particles in the developer. This finding was unexpected and unpredictable in that one might have expected some of the toner particles in the developer to acquire the level of charge that would be expected to be imparted by only one of the types of carrier particles in the mixture and some of the toner particles to acquire a significantly different level of charge than would be expected to be imparted by only the other type of carrier particles in the mixture. This would have been a reasonable expectation, because there were carriers used in the carrier mixtures that when alone in a developer would not impart charge to toner or would charge the toner to the opposite charge than the result when the carrier was in the mixture. However the inventors, through microscopic studies of developers containing mixtures of carrier particles in accordance with the invention, observed that each type of carrier particles in the mixture in a developer had toner particles clinging thereto by means of electrostatic attraction. Therefore, the present invention provides a mixture of different types of carrier particles which triboelectrically charge toner particles to a relatively equal level of electrostatic charge having experienced the sum of the triboelectric effects of the different carrier particles in the mixture.

The carrier mixture can impart a positive or negative triboelectric charge to the toner in a developer composition. The carrier mixture consists of at least two types of carrier particles, wherein one of the types of carrier particles occupies a position in the triboelectric continuum different from the position of the other type. Preferably, for typical toner particle sizes of about 10 to 14 micrometers (μm), the absolute difference between the positions on the triboelectric continuum of the two types of carrier particles of the carrier mixture is at least 5 microcoulombs per gram (μC/g). More preferably, the absolute difference between the positions on the triboelectric continuum of the two types of carrier particles of the carrier mixture is at least 10 μC/g. For smaller toner particle sizes of for example less than 5 μm, the difference preferably is at least 50 μC/g. The position of the carrier particles on the triboelectric continuum is determined by measuring the amount of triboelectric charge acquired by the carrier particles when they charge up against toner particles and is a function of the toner particles that the carrier particles contact.

The carrier particles useful in this invention can consist of coated and uncoated carrier cores. The carrier core materials can comprise conductive, non-conductive, magnetic, or non-magnetic materials. For example, carrier cores can comprise glass beads; crystals of inorganic salts such as aluminum potassium chloride; other salts such as ammonium chloride or sodium nitrate; granular zircon; granular silicon; silicon dioxide; hard resin particles such as poly(methyl methacrylate); metallic materials such as iron, steel, nickel, carborundum, cobalt, oxidized iron; or mixtures or alloys of any of the foregoing. See, for example, U.S. Pat. Nos. 3,850,663 and 3,970,571. Especially useful in magnetic brush development schemes are iron particles such as porous iron particles having oxidized surfaces, steel particles, and other "hard" or "soft" ferromagnetic materials such as gamma ferric oxides or ferrites, such as ferrites of barium, strontium, lead, magnesium, lanthanum or aluminum, or composites of such materials dispersed in a continuous matrix. See, for example, U.S. Pat. Nos. 4,042,518; 4,478,925; 4,546,060; 4,764,445; 4,855,205; 4,855,206; and 5,061,586, incorporated herein by reference.

U.S. Pat. No. 4,546,060 discloses an electrographic, two component dry developer composition comprising charged toner particles and oppositely charged, magnetic carrier particles, which (a) comprise a magnetic material exhibiting "hard" magnetic properties, as characterized by a coercivity of at least 300 gauss and (b) exhibit an induced magnetic moment of at least 20 EMU/gm when in an applied field of 1000 guass. The developer is employed in combination with a magnetic applicator comprising a rotatable magnetic core and an outer, nonmagnetizable shell to develop electrostatic images.

The term "carrier particle" refers to a coated or uncoated carrier particle. Carrier particles in the carrier mixture useful in accordance with the invention comprise such core particles overcoated with 0–5 pph (parts per hundred parts core material) of a continuous or discontinuous layer of other material. The coating material can be a metallic or polymeric material preferably provided that at least one of the types of carrier particles in the mixture are coated with polymeric material, preferably between 1–2 pph by weight. Many such materials are known to be useful in coatings on carrier core particles, among which are, for example, various cellulosic polymers, styrene polymers, acrylic polymers, fluoropolymers, vinyl polymers, polyesters, silicones and copolymers thereof. See, for example, U.S. Pat. Nos. 4,614,700; 4,546,060; 4,478,925; 4,076,857; 3,970,571; 4,599,290; 3,736,257; and 3,718,594, incorporated herein by reference. Examples of such coating materials include poly(vinylidene fluoride), poly(methyl methacrylate), vinylidene chloride-acrylonitrile copolymer, (85/15) vinylidene chloride-acrylonitrile-acrylic acid (79/15/6) terpolymer, cellulose nitrate chlorotrifluoroethylene vinylidene fluoride, diphenylene sulfone, epoxy/amine curing agent, cellulose acetate butyrate, acrylonitrile-butadiene-styrene terpolymer, chlorosulfonated polyethylene, polyethylene, polystyrene, ethyl cellulose, phenol formaldehyde, polyurethane, alkyl-substituted polyvinyl pyrrolidone, polyvinyl formal, polybisphenol-A-carbonate, alkyl-substituted polyvinyl pyrrolidone, diallyl phthalate, and block copolymers, such as, styrene-butadiene block copolymer, styrene-isoprene block copolymer, and styrene-ethylene-propylene block copolymer.

Preferably, the coating materials are nonionic, unless carrier particles with ionomeric coatings are present in such small quantities in a carrier mixture that they do not affect the triboelectric characteristics of other carrier particles in a carrier mixture of this invention. Examples of ionomeric coating materials which will not work in this invention include those disclosed in U.S. Pat. No. 3,795,618, incorporated herein by reference.

Methods of coating a polymer onto carrier core particles in a continuous or discontinuous configuration of various uniform or non-uniform thickness are well known. Some useful coating methods include solution-coating, spray application, plating, tumbling, shaking, fluidized bed coating, and melt-coating. Any such methods can be employed to prepare the coated carrier particles of this invention. See, for example, U.S. Pat. Nos. 4,546,060; 4,478,925; 4,233,387; 4,209,550; and 3,507,686, incorporated herein by reference.

In coating polymers useful for the present invention, relative amounts of the polymer can be varied to achieve the desired properties. Optimum amounts will depend on the nature of toner particles with which the carrier particles are intended to be subsequently mixed in order to form a developer and the amount of charge per unit mass desired. For example, in the specific case of strontium ferrite core particles having average particle diameters in the range of about 30 to 40 micrometers, the coating will usually comprise, by weight, 0–5 pph coating material (parts per hundred parts core material) or less, if melt-coating is employed (because higher proportions of coating material may make it very difficult to properly break apart the solidified mass to yield the discrete coated carrier particles) and about 0–5 pph coating material or less, if solution-coating (because higher proportions of coating material can cause particle agglomeration while driving off the solvent, with consequent incompleteness and/or non-uniformity of the coating). Note again that these preferable upper limits of weight ratios of coating material to core material will vary as surface area-to-mass ratio of the core particles varies; i.e., the preferable upper limits will be higher when surface area-to-mass is higher than in the specific case noted and will be lower when surface area-to-mass is lower than in the specific case noted.

The resultant carrier particles can be spherical or irregular in shape, can have smooth or rough surfaces, and can be of any size known to be useful in developers. Conventional carrier particles usually have an average particle diameter in the range of about 2 to about 1200 micrometers, preferably 20–300 micrometers.

In some preferred embodiments of the invention strontium ferrite core particles having an average diameter of about 30 μm were dry mixed with small polymethylmethacrylate particles (PMMA) in a container on a roll mill. The amount of PMMA used was 2 pph. The mixture was then heated for approximately three hours at 230° C. in air. The particles were then broken up and sieved to obtain the desired carrier particle size. The cores were then magnetized prior to use. Polyvinylidene fluoride coated carrier particles were made using essentially the same process and then these two types of coated carriers were mixed together in various proportions to create mixtures of carrier particles useful in this invention.

In forming electrographic developers, the inventive mixtures of carrier particles, which are preferably mixtures of uncoated and coated carrier particles and more preferably two different types of coated carrier particles, can be combined with any suitable toner particles known to be useful in dry electrographic developers. Carriers of the present invention are useful in developers wherein the toner particles triboelectrically acquire negative or positive charges during mixing, while the carrier particles acquire positive or negative charges, respectively.

Useful toner particles comprise at least a binder resin and, optionally, other addenda such as colorants, charge-control agents, release agents, etc., as is well known.

Many binders have been reported in the published literature as being useful as dry toner binders. These include vinyl polymers, such as homopolymers and copolymers of styrene, and condensation polymers such as polyesters and copolyesters.

One or more vinyl type monomers can be used. Although certain monomers are preferred, namely styrene and butyl acrylate, the method of the invention is not limited to those monomers and can utilize other monomers which are capable of addition polymerization and which yield polymer useful as toner binders. Examples of suitable vinyl monomers include styrene, alpha-methylstyrene, para-chlorostyrene, unsubstituted or substituted monocarboxylic acids having a double bond such as acrylic acid, methyl acrylate, ethyl acrylate, butyl acrylate, dodecyl acrylate, octyl acrylate, phenyl acrylate, methacrylic acid, methyl methacrylate, ethyl methacrylate, butyl methacrylate, octyl methacrylate acrylonitrile, methacrylonitrile, and acrylamide; unsubstituted or substituted dicarboxylic acids having a double bond such as maleic acid, butyl maleate, methyl maleate, and dimethyl maleate; vinyl esters such as vinyl chloride, vinyl acetate, and vinyl esters such as vinyl chloride, vinyl acetate, and vinyl benzoate; olefins such as ethylene, propylene, and butylene; vinyl ketones such as vinyl methyl ketone and vinyl hexyl ketone; vinyl ethers such as vinyl methyl ether, vinyl ethyl ether, and vinyl isobutyl ether.

In a currently preferred embodiment of the invention, the largest component of the monomer composition is styrene or a styrene homologue such as methyl styrene. It is preferred that the styrene monomer is used in an amount of at least about 60 weight percent and more preferably at least about 75 weight percent of the monomer composition. The composition also contains at least one alkyl acrylate or methacrylate. Preferably, this is a lower alkyl acrylate or methacrylate, in which the alkyl group contains from 1 to about 6 carbon atoms. Many of the toner binders useful in this invention are crosslinked.

Preferred are fusible styrene-acrylic copolymers which are covalently lightly crosslinked with a divinyl compounds such as divinylbenzene as disclosed in the patent to Jadwin et al, U.S. Pat. No. Re. 31,072, incorporated herein by reference. Also especially useful are polyesters of aromatic dicarboxylic acids with one or more aliphatic diols, such as polyesters of isophthalic or terephthalic acid with diols such as ethylene glycol, cyclohexane dimethanol and biphenols.

Useful binder resins have fusing temperatures in the range of about 100° C. to 240° C. so that the toner particles can readily be fused after development. Preferred are resins which fuse in the range of about 110° C. to 190° C. If toner transfer is made to receiving sheets which can withstand higher temperatures, polymers of higher fusing temperatures can be used.

A colorant for the toner can be selected from a wide variety of dyes and pigments such as those disclosed, for example, in U.S. Pat. No. Re. 31,072 and in U.S. Pat. Nos. 4,160,644; 4,416,965; 4,414,152; and 2,229,513. A particularly useful colorant for toners to be used in black and white electrophotographic copying machines is carbon black. The amount of colorant in the toner can vary over a wide range, for instance, from 1 to 30 weight percent of the toner. For some uses, no colorant is added to the toner, but usually from about 1 to 6 weight percent of colorant is present.

Another commonly used additive is a charge control agent which modify the triboelectric charging properties of toner particles. Charge control agents are usually ionic compounds such as certain metal-azo complexes and metal salts and complexes of certain benzoic and naphthoic acids. Suitable charge control agents are disclosed, for example, in U.S. Pat. Nos. 3,893,935; 4,079,014; 4,323,634; 4,656,112; 4,206,064; 4,824,751; 4,433,040; and British Patent Nos. 1,501,065 and 1,420,839 incorporated herein by reference. Only a small concentration of charge control agent is normally used in the toner composition, e.g., from about 0.05 to 6 weight percent and preferably from 0.05 to 2.0 weight percent.

The toner can also contain other additives of the type used in previous toners, including magnetic pigments, leveling agents, surfactants, stabilizers, and the like. The total quantity of such additives can vary. A present preference is to employ not more than about 10 weight percent of such additives on a total toner powder composition weight basis. Dry styrenic/acrylic copolymer toners can optionally incorporate a small quantity of low surface energy material, as described in U.S. Pat. Nos. 4,517,272 and 4,758,491. Optionally the toner can contain a particulate additive on its surface such as the particulate additive disclosed in U.S. Pat. No. 5,192,637.

The toner can be prepared by melt processing in a two roll mill or extruder. This procedure can include melt blending of other materials with the polymer, such as toner addenda. A preformed mechanical blend of particulate polymer particles, colorants and other toner additives can be prepared and then roll milled or extruded. The roll milling, extrusion, or other melt processing is performed at a temperature sufficient to achieve a uniformly blended composition. The resulting material, referred to as a melt product or melt slab is then cooled. For a polymer having a glass transition temperature in the range of about 50° C. to about 120° C., or a melting temperature in the range of about 65° C. to about 200° C., a melt blending temperature in the range of about 90° C. to about 240° C. is suitable using a roll mill or extruder. Melt blending times, that is, the exposure period for melt blending at elevated temperature, are in the range of about 1 to about 60 minutes.

The melt product is pulverized to a volume average particle size of from about 0.5 to 25 micrometers to yield a particulate of the invention. It is generally preferred to first grind the melt product prior to a specific pulverizing operation. The grinding can be carried out by any convenient procedure. For example, the solid composition can be crushed and then ground using, for example, a fluid energy or jet mill, such as described in U.S. Pat. No. 4,089,472, and can then be classified in one or more steps. The size of the particles is then further reduced by use of a high shear pulverizing device such as a fluid energy mill.

Toners useful in this invention can also be prepared directly by the suspension polymerization limited coalescence technique or the evaporative limited coalescence technique as described in U. S. Pat. Nos. 3,502,582; 4,833,060; 4,835,084; 4,912,009; 4,965,131; and 5,133,992; incorporated herein by reference.

The term "particle size" used herein, means the median volume weighted diameter as measured by conventional diameter measuring devices, such as a Coulter Multisizer, sold by Coulter, Inc. of Hialeah, Fla. Median volume weighted diameter is the diameter of an equivalent weight spherical particle which represents the median for a sample.

Preferably the toner particles range in diameter from 4.0 to 20 micrometers. Preferably, the average particle size ratio of carrier to toner is within the range of about 20:1 to about 2:1. However, carrier-to-toner average particle size ratios of as high as 50:1 or as low as 1:1 are also useful.

In developers containing carriers of the invention, various concentrations of toner can be employed depending on the carrier and/or toner particle size. Accordingly, the developer can contain from about 70 to 99 weight percent carrier and from about 30 to 1 weight percent toner based on the total weight of the developer. Most preferably, the developer contains from about 80 to 99 weight percent carrier and the toner concentration is from about 20 to 1 weight percent of the developer.

The mixing of the developer composition can be done by any method well known in the art for providing a well-blended mixture including ribbon blending and other auger blending methods. Developer compositions containing carriers of this invention can be used in various known ways to develop electrostatic charge patterns or latent images. Such developable charge patterns can be prepared by a number of means and be carried, for example, on a light-sensitive dielectric-surfaced element such as an insulator-coated conductive sheet. One suitable development technique involves applying toner particles from a developer formed into a magnetic brush by a magnetic applicator apparatus. After imagewise deposition of the toner particles, the image can be fixed, e.g., by heating the toner to cause it to fuse to the substrate carrying the toner. If desired, the unfused image can be transferred to a receiver such as a blank sheet of paper and then fused to form a permanent image.

The following examples are presented to further illustrate some preferred embodiments of carrier mixtures of the invention and to compare their properties in developers to those of carriers outside the scope of the invention. The examples show that the charge on a toner in a developer can be adjusted in a predictable manner by changing the composition of a carrier mixture. Additionally, the examples show how to determine the maximum and minimum toner charge and the relationship of percent composition of a carrier mixture to the toner charge. That is, once a carrier mixture is formulated from the carriers described above, before using it in an electrostatographic machine, its ability to triboelectrically charge a selected toner can be tested by one or more of the methods described in the examples.

EXAMPLES

In all of the following examples and comparative examples, the carrier particles comprised strontium ferrite or strontium-lanthanum ferrite carrier cores that were either uncoated or melt- or solution-coated with various polymers. The method of preparing the ferrite carrier cores is well known in the art, for example, see U.S. Pat. No. 4,764,445, incorporated herein by reference. The coated carrier cores were prepared by using a formulation comprising 0 to 5 parts by weight of various polymers, and 100 parts by weight of the ferrite particles.

For melt coated carrier particles, the polymer was first dry blended with the ferrite carrier core by placing the polymer and cores in a container and roll milling the container for 2 hours. The resulting blend was sieved to remove large agglomerates and placed in an oven heated to 230° C. After 2 to 4 hours the carrier was removed from the oven and allowed to cool and sieved again to break the agglomerates prior to use.

For solution coated carrier cores, 0 to 5 parts by weight of the polymer was dissolved in a suitable solvent such as dichloromethane or ethyl acetate. 100 parts by weight of the ferrite particles were mixed into the solution. The mixture was agitated while being maintained at a temperature near the boiling point of the solvent to evaporate the solvent. Then the solids were allowed to cool to room temperature to yield the coated carrier particles.

Charge to Mass Measurements

In the Examples the triboelectric properties of the developer were determined by measuring the charge to mass of the toner particles by one of three conventional techniques.

The First Technique involved preparing 4.0 grams of developer by mixing the toner with a mixture of carrier particles. The toner concentration in the developer ranged from 1 to 20 percent by weight of the carrier(s) depending on the size of toner and carrier particles. The mixture was gently agitated in an appropriate bottle or vial to allow the developer to reach its optimum maximum charge. This was achieved by a wrist-action-robot shaker operating at 2 Hz and an overall amplitude of about 11 cm, for two minutes. The toner charge level was measured by placing 0.05 to 0.2 grams of charged developer in a sample dish situated between electrode plates and subjecting it, simultaneously for 2 minutes, to a 60 Hz magnetic field to cause developer agitation and to an electric field of about 2,000 volts/cm between the plates. Some toner released from the carrier and attached to and collected on the plate having polarity opposite to the toner charge. The total toner charge was measured by an electrometer connected to the plate. The toner charge divided by the weight of the toner on the plate yielded the charge to mass of toner in microcoulombs per gram (μC/gm).

The Second Technique was the same as the first technique except that a magnetic stirrer was placed under the sample dish and rotated at 5,000 rpm while an electric field of 6,000 volts/cm was applied across the plates.

The Third Technique involved placing 0.3 g of developer on a mini-magnetic brush rotating at 1,500 rpm. An organic photoconductive element was passed over the magnetic brush at 0.64 cm per second while a 300 volt electric field was applied to the magnetic brush. The gap between the organic photoconductor and the magnetic brush shell was 0.75 mm. The surface of photoconductive element was attached to an electrometer which measured the total toner charge on the photoconductive element. By dividing the toner by the mass of toner developed on the surface of the photoconductive element, the charge to mass ratio was calculated.

Example 1

A toner was formulated by compounding 100 parts of a cross-linked styrene-butyl acrylate copolymer with 6 parts Black Pearls™ 430 carbon black (Cabot Corporation, Boston Mass.) with 1 part of dimethyl stearyl benzyl ammonium meta nitro benzene sulfonate (charge control agent) at 170° C. in an extruder. The toner binder consisted of 77 weight percent of styrene and 23 weight percent of butyl acrylate along with 0.4 parts of divinylbenzene cross linking agent and was prepared by suspension polymerization technique. The resulting melt compounded product was pulverized in a fluid energy mill to yield an average particle size of 12 microns. The developer was made by combining 12 grams of toner with 88 grams of the carrier mixture. The carrier mixture consisted of strontium ferrite carrier cores melt-coated at 230° C. with 2 pph of polmethylmethacrylate (PMMA) and strontium ferrite carrier cores melt-coated at 230° C. with 2 pph polyvinylidene fluoride (Kynar™ 301F, also referred to in the examples as "Kynar™", manufactured by Pennwalt Corp.). The percentage by weight of polyvinylidene fluoride coated carrier particles in the carrier composition is listed first in the column labeled "Carrier Mixture Composition" in Table 1. For example, for the first sample listed in Table 1, the carrier mixture consisted of 100 percent by weight polyvinylidene fluoride and 0 percent by weight PMMA. The charge to mass ratio was calculated by the Third Technique described above. The results in Table 1 show that by changing the relative amounts of two different coated carriers, it is possible to control the charge to mass of the developer. The maximum charge is obtained when 100 percent of polyvinylidene fluoride coated carrier particles is used as the carrier, while the lowest charge is obtained when carrier particles are only coated with polymethyl methacrylate. A continuously decreasing charge to mass is obtained as the ratio of the two coated carrier particles is changed from consisting of 100 percent by weight polyvinylidene fluoride to 25 percent by weight polyvinylidene fluoride.

TABLE 1

Results of Example 1

| Carrier mixture Composition | μC/g |
|---|---|
| 100/0 | 36.25 |
| 75/25 | 28.44 |
| 50/50 | 20.99 |
| 25/75 | 13.29 |

Example 2

Example 1 was repeated except that the toner binder polymer was prepared by emulsion polymerization and 1.5 pph of dimethyl stearyl benzyl ammonium chloride was used as the charge control agent. The volume average particle size of the toner was 4.5 microns. The developer was prepared having a 5 percent by weight toner concentration. The charge to mass was measured by the Second Technique described above. The same carrier particles in the carrier mixtures of Example 1 were used in this Example. The results of this Example are summarized in Table 2. (Again, the weight percent of polyvinylidene fluoride in the carrier mixture is listed first in the "Carrier Mixture Composition" column.)

Example 1 and Example 2 show that various mixtures of two types of carrier particles can be used to continuously increase or decrease the toner charge to mass for different toner formulations.

TABLE 2

Results of Example 2

| Carrier Mixture Composition | μC/g |
|---|---|
| 100/0 | 105.0 |
| 75/25 | 81.5 |
| 50/50 | 58.0 |
| 25/75 | 43.0 |
| 0/100 | 0 |

Example 3–9

Example 1 was repeated except various different pigments were used in place of carbon black in the toner. The pigments used are listed in Table 3. They are all available from BASF, Inc. The charge to mass of the toners measured for the developers of these examples are compiled in Table 4. The results indicate that this invention is not limited by the pigment selected for the toner formulation.

TABLE 3

Pigment Table

| Example No. | Pigment |
|---|---|
| 3 | Sicofast Yellow NBD-1357 ™ |
| 4 | Heliogen blue D-7072-DD ™ |
| 5 | Ecunal Violet D-5480 ™ |
| 6 | Lithol Red NBD-3560 ™ |
| 7 | Heliogen Green D-8730 ™ |
| 8 | Fanal Pink D-4830 ™ |
| 9 | Lithol Rubine NBD-4573 ™ |

TABLE 4

Results of Example 3–9

| Example No. | Carrier Mixture Composition | μC/g |
|---|---|---|
| 3 | 100/0 | 69.23 |
| | 75/25 | 52.50 |
| | 50/50 | 37.50 |
| | 25/75 | 22.24 |
| 4 | 100/0 | 73.25 |
| | 75/25 | 56.09 |
| | 50/50 | 39.91 |
| | 25/75 | 23.33 |
| 5 | 100/0 | 79.73 |
| | 75/25 | 60.00 |
| | 50/50 | 45.20 |
| | 25/75 | 26.55 |
| 6 | 100/0 | 66.23 |

TABLE 4-continued

Results of Example 3–9

| Example No. | Carrier Mixture Composition | μC/g |
|---|---|---|
| | 75/25 | 49.23 |
| | 50/50 | 32.10 |
| | 25/75 | 16.59 |
| 7 | 100/0 | 70.67 |
| | 75/25 | 54.37 |
| | 50/50 | 39.06 |
| | 25/75 | 21.39 |
| 8 | 100/0 | 94.33 |
| | 75/25 | 74.05 |
| | 50/50 | 56.98 |
| | 25/75 | 37.73 |
| 9 | 100/0 | 64.37 |
| | 75/25 | 48.51 |
| | 50/50 | 33.97 |
| | 25/75 | 20.06 |

Examples 10 and 11

Examples 8 and 9, corresponding to Examples 10 and 11 respectively, were repeated except that the Third Technique for charge to mass measurements described above was used and the developer was "aged" prior to the measurements. The developer was "aged" (exercised) by placing 4 gram samples of developer into plastic vials, capping the vials, and placing each vial for 5 minutes on a "bottle brush" device comprising a magnetic toner roller with a stationary shell and a magnetic core rotating at 2,000 rpm. The magnetic core had 12 magnetic poles arranged around its periphery in alternating north-south fashion. The control of the charge to mass is still evident for an "aged" developer by using the third technique. The results of this example are compiled in Table 5.

TABLE 5

Results of Examples 10 and 11

| Example No. | Carrier Mixture Composition | 5 Min. μC/g |
|---|---|---|
| 10 | 100/0 | 89.39 |
| | 75/25 | 71.35 |
| | 50/50 | 49.89 |
| | 25/75 | 34.07 |
| 11 | 100/0 | 46.85 |
| | 75/25 | 33.13 |
| | 50/50 | 23.15 |
| | 25/25 | 13.58 |

Example 12

Example 2 was repeated except that charge to mass measurements were carried out by the First Technique and instead of the PMMA coated carrier of Example 2, the carrier was coated with a copolymer consisting of 80 percent by weight styrene and 20 percent by weight methyl methacrylate. The results of this example are compiled in Table 6. (Again, the percent by weight of the carrier particles coated with polyvinylidene fluoride, Kynar™, in the carrier mixture is listed first in the "Carrier Mixture Composition" column of Table 6.

TABLE 6

Results of Example 12

| Carrier Mixture Composition | μC/g |
|---|---|
| 100/0 | 124.0 |
| 75/25 | 110.0 |
| 50/50 | 79.0 |
| 30/70 | 58.0 |
| 20/80 | 41.0 |
| 10/90 | 29.0 |
| 0/100 | 1.0 |

Example 13

Example 1 was repeated except that the carrier mixture consisted of polyvinylidene fluoride (Kynar™ 301F) and Kraton™ WRC 3429, manufactured by Shell Chemicals, Houston Tex. Kraton™ WRC 3429 is an ABA type tri-block copolymer consisting of styrene-isoprene-styrene blocks. The Kraton™ coated carrier particles were made by solution coating strontium ferrite cores using dichloromethane as the solvent. The percent by weight of polyvinylidene fluoride coated carrier in the carrier mixture is listed first in the "Carrier Mixture Composition" column of Table 7. The toner charge to mass measurements determined by the Third Technique are compiled in Table 7.

This example shows that using the carrier mixture of this invention makes it possible to use carrier particles which are coated by different techniques. The Kraton™ coated particles were solution coated, and the Kynar™ coated particles were melt-coated.

Results of Example 13

| Carrier Mixture Composition | μC/g |
|---|---|
| 75/25 | 26.9 |
| 50/50 | 18.9 |
| 25/75 | 11.0 |

Example 14

This was an example of a negative triboelectrically charging carrier mixture using uncoated strontium ferrite and strontium ferrite melt-coated with 2 pph, PMMA, Soken™ MP 1100, sold by Nachem, Inc. In Table 8 the weight percent of the uncoated carrier particles in the carrier mixture is listed first in the column labeled "Carrier Mixture Composition" The toner was a negative charging toner, because 2 pph of negative charge agent, Pro-Toner CCA-7™, manufactured by ICI, Inc. was used, otherwise the toner was the same as Example 1. The charge to mass measurements were made by the First Technique on fresh and aged developer. The developer was aged as described in Examples 10 and 11. The results of the fresh developer are in the column labeled "μC/g" and the results of the aged developer are listed in the column labeled "5 Min. μC/g" in Table 8.

TABLE 8

| Results of Example 14 | | |
|---|---|---|
| Carrier Mixture Composition | μC/g | 5 Min. μC/g |
| 0/100 | −22.1 | −19.4 |
| 20/80 | −41.0 | −24.8 |
| 40/60 | −50.5 | −31.7 |
| 60/40 | −50.8 | −37.5 |
| 80/20 | −51.8 | −45.0 |
| 100/0 | −52.2 | −47.5 |

Example 15

Example 14 was repeated except the carrier mixture consisted of uncoated strontium ferrite and strontium ferrite cores coated with 2 pph Soken™ MP 2029, sold by Nachem, Inc., a copolymer consisting of 20 percent by weight of methyl methacrylate and 80 percent by weight styrene. The results are in Table 9.

TABLE 9

| Results of Example 15 | | |
|---|---|---|
| Carrier Mixture Composition | μC/g | 5 Min. μC/g |
| 0/100 | −13.3 | −14.1 |
| 20/80 | −26.3 | −19.9 |
| 40/60 | −36.8 | −26.3 |
| 60/40 | −43.4 | −33.0 |
| 80/20 | −46.6 | −40.0 |
| 100/0 | −52.2 | −47.5 |

Example 16

In this example, a toner having a particle size of 3.5 microns was prepared by the limited coalescence technique as described in U.S. Pat. No. 4,833,060. The toner contained 15 percent by weight of Fanal Pink pigment and 1 percent by weight of tetradecyl pyridinium tetraphenyl borate charge agent, and 84 percent by weight toner binder. The toner binder consisted of 80 percent by weight styrene and 20 percent by weight butylacrylate (Piccotoner™ 1221, sold by Hercules-Sanyo, Inc.). Carrier mixtures consisting of polyvinylidene fluoride (Kynar™) coated carrier particles and PMMA coated carrier particles were used. The carrier cores were strontium-lanthanum ferrite. The percentage of polyvinylidene fluoride in the carrier mixture is listed first in the "Carrier Mixture Composition" column. The charge to mass for these developers was measured by the Second Technique and the results are shown in Table 10.

TABLE 10

| Blends of Example 16 | |
|---|---|
| Carrier Mixture Composition | μC/g |
| 100/0 | 412 |
| 75/25 | 285 |
| 50/50 | 140 |
| 25/75 | 100 |
| 0/100 | 0 |

Example 17

The toner of Example 16 was used in the developer compositions of this Example. The carrier mixture consisted of two types of carrier particles, each type of carrier particles had blended coatings with different ratios of polyvinylidene fluoride (Kynar™) and PMMA. One type of carrier particles was coated with 1.5 pph of Kynar™ and 0.5 pph of PMMA and the other type of carrier particles was coated with 1 pph of Kynar™ and 1 pph of PMMA. The carrier cores were strontium-lanthanum ferrite. The percent by weight of the carrier particles having the coating consisting of 1.5 pph Kynar™ and 0.5 pph PMMA is listed first in the column labeled "Carrier Mixture Composition" in Table 11. The charge to mass for these developers was measured by the Second Technique and the results are shown in Table 11.

TABLE 11

| Results of Example 17 | |
|---|---|
| Carrier Mixture Composition | μC/g |
| 100/0 | 275 |
| 75/25 | 245 |
| 50/50 | 220 |
| 25/75 | 194 |
| 0/100 | 160 |

Example 18

Example 17 was repeated except that one type of carrier in the carrier mixture was coated with 1.5 pph of polyvinylidene fluoride (Kynar™) and 0.5 pph of PMMA and the other was coated with 0.5 pph of Kynar™ and 1.5 pph of PMMA. The carrier cores were strontium-lanthanum ferrite. The percent by weight of the carrier particles having the coating consisting of 1.5 pph Kynar™ and 0.5 pph PMMA is listed first in the "Carrier Mixture Composition" column in Table 12. The charge to mass for these developers was measured by the Second Technique and are summarized in Table 12.

TABLE 12

| Results of Example 18 | |
|---|---|
| Carrier Mixture Composition | μC/g |
| 100/0 | 275 |
| 75/25 | 225 |
| 50/50 | 190 |
| 25/75 | 140 |
| 0/100 | 100 |

Comparative Example A

Attempts were made to make a blended carrier coating with various amounts of Kynar™ and Kraton™ WRC at 2 pph of total coverage. The solution coating approach could not be used because a common solvent which would be practical to use could not be found. The melt-coating technique also yielded poor coatings as Kynar™ and Kraton™ were incompatible. Compatibility is necessary to obtain a uniform coating and for the mechanical integrity of the coating. It was found that when an incompatible mixture of polymers was used to make carrier coatings, the charge to mass of the toners was poor and unstable, because when exercised one of the components of the coating would not adhere to the core.

The results of Comparative Example A can be compared to the result of Example 13, wherein Kraton™ coated carrier particles and Kynar™ coated carrier particles were combined to form a carrier mixture which was successfully used to control the toner charge.

Comparative Examples B & C

Carriers having coatings consisting of blends of polyvinylidene fluoride (Kynar™) and PMMA, rather than carrier mixtures, were used in this Example. The developer consisted of 12% by weight of toner and 88% by weight of carrier. The toners used in Example B and C corresponded to those used in Examples 8 and 9, respectively. The charge to mass of the toners was measured using the Third Technique for fresh and aged toner and are listed in Table 13. The results of the fresh measurements for Comparative Examples B and C are comparable to Examples 8 and 9, respectively. The results of the aged measurements for Comparative Examples B and C are comparable to Examples 10 and 11, respectively.

TABLE 13

Results of Comparative Examples B & C

| Example | Composition of Blended Coating | μC/g | 5 Min. μC/g |
|---|---|---|---|
| B | 100/0 | 94.33 | 89.39 |
| | 75/25 | 43.61 | 39.29 |
| | 50/50 | 38.94 | 33.44 |
| | 25/75 | bicharged | bicharged |
| C | 100/0 | 64.37 | 46.85 |
| | 75/0 | 27.14 | 15.14 |
| | 50/50 | 19.89 | 8.08 |
| | 25/75 | bicharged | bicharged |

The results of Comparative Examples B compared to Examples 8 and 10 and the results of Comparative Example C to Examples 9 and 11 indicate that the mixtures of carrier particles, which were separately coated by different methods, provide better control over the toner charge and allow for more incremental adjustments in the toner charge than blended coatings on carrier particles. The mixture of carriers with different coatings also makes it possible to adjust the toner charge by adjusting the composition of the carrier while the carrier is being used in an electrostatographic machine.

Example 18

250g of developer consisting of 10 percent by weight Ektaprint™ K toner and 90 percent by weight of carrier consisting of a blend of 1.5 pph Kynar™ and 0.5 pph on a strontium ferrite carrier core were loaded into a prototype Kodak Ektaprint™ 2110 electrophotographic machine and run for 50,000 copies. The charge to mass of the toner was measured by the First Technique. Then, 10 percent of the developer was replaced with an equal amount of developer consisting of 90 percent by weight 2.0 pph polyvinylidene fluoride (Kynar™) coated carrier and 10 percent be weight toner, 1,000 copies were made, and the charge per mass of the toner measured. The steps of replacing 10 percent of the developer with developer containing 90 percent by weight 2.0 pph polyvinylidene fluoride coated carrier and 10 percent by weight toner, making 1,000 copies, and measuring the charge to mass of the toner was repeated. Then, 1,000 additional copies were made and the charge to mass was measured without changing the composition of the developer to check the charge to mass stability of the developer. Then 10 percent by weight of the developer was replaced with developer containing 90 percent by weight 2.0 pph PMMA and 10 percent by weight toner, 1,000 copies were made and the charge to mass of the toner was measured. These steps were repeated two more times. Then twice 2,000 additional copies were made and the charge to mass was measured without changing the composition of the developer to check the charge to mass stability of the developer. The results of this test are in Table 14. The approximate composition of the carrier is listed in the "Carrier Mixture Composition" column in Table 14. The percent by weight of the carrier consisting of the blend of 1.5 pph Kynar™ and 0.5 pph PMMA is listed first, the percent by weight of the 2 pph Kynar™ coated carrier is listed second and the percent by weight of the 2.0 pph PMMA is listed third in the "Carrier Mixture Composition" column.

TABLE 4

Results of Example 18

| No. of Copies | Carrier Mixture Composition | μC/g |
|---|---|---|
| 50,000 | 100/0/0 | 8 |
| 51,000 | 91/9/0 | 13 |
| 52,000 | 82/18/0 | 15.2 |
| 53,000 | 82/18/0 | 15.2 |
| 54,000 | 74/17/9 | 14.1 |
| 55,000 | 67/15/18 | 12.9 |
| 56,000 | 61/14/25 | 12.0 |
| 58,000 | 61/14/25 | 12.0 |
| 60,000 | 61/14/25 | 12.0 |

This example shows that by varying the compositions of mixtures of different types of carrier particles in an electrophotographic machine, the charge per mass of the toner can be continuously increased or decreased during the operation of the machine. This is very beneficial, if for example, weather conditions or the aging of the machine or developer detrimentally affect transfer or charging and these problems need to be compensated for by increasing or decreasing the toner charge to mass.

The invention has been described in detail with particular reference to certain preferred embodiments thereof, but it should be understood that variations and modifications can be effected within the spirit and scope of the invention.

What is claimed is:

1. A mixture of carrier particles useful in electrographic developers comprising toners and carrier particles, said mixture comprises at least a first type of carrier particles and a second type of carrier particles, wherein said first type of carrier particles occupies a position in the triboelectric continuum different from the position in the triboelectric continuum occupied by said second type of carrier particles, said positions determined relative to said toner, and the level of charge to which said mixture of carrier particles charges said toner in a developer composition continuously decreases from a high level when said carrier mixture comprises all of said first type of carrier particles to a low level when said carrier mixture comprises all of said second type of carrier particles, and wherein said first and said second types of carrier particles comprise hard ferrite, and said mixture of carrier particles is employed in combination with a magnetic applicator comprising a rotatable magnetic core and an outer non-magnetizable shell.

2. The mixture of carrier particles of claim 1, wherein the absolute value of the difference between the triboelectric charge of said first type of said carrier particles and the triboelectric charge of said second type of carrier particles is at least 10 μC/g.

3. The mixture of carrier particles of claim 1, wherein at least one of said types of carrier particles comprises cores having a polymeric coating.

4. The mixture of carrier particles of claim 3, wherein said polymeric coating comprises nonionic polymers.

5. The mixture of carrier particles of claim 3, wherein said polymeric coating comprises a blend of two or more polymers.

6. The mixture of carrier particles of claim 3, wherein said polymeric coating comprises one or more polymers selected from the group consisting of silicones, cellulosic polymers, styrene polymers, acrylic polymers, fluoropolymers, vinyl polymers, polyesters and copolymers thereof.

7. The mixture of carrier particles of claim 3, wherein said polymeric coating comprises one or more polymers selected from the group consisting of poly(methyl methacrylate), poly(vinylidene fluoride), vinylidene chloride-acrylonitrile copolymer, vinylidene chloride-acrylonitrile-acrylic acid terpolymer, cellulose nitrate chlorotrifluoroethylene vinylidene fluoride, diphenylene sulfone, epoxy/amine curing agent, cellulose acetate butyrate, acrylonitrile-butadiene-styrene terpolymer, chlorosulfonated polyethylene, polyethylene, polystyrene, ethyl cellulose, phenol formaldehyde, polyurethane, alkyl-substituted polyvinyl pyrrolidone, polyvinyl formal, poly-bisphenol-A-carbonate, alkyl-substituted polyvinyl pyrrolidone, diallyl phthalate, and styrene-butadiene block copolymer, styrene-isoprene block copolymer, and styrene-ethylene-propylene block copolymer.

8. The mixture of carrier particles of claim 3, wherein said polymeric coating comprises poly(vinylidene fluoride).

9. The mixture of carrier particles of claim 3, wherein said polymeric coating comprises poly(methyl methacrylate).

10. The mixture of first and second types of carrier particles of claim 1, wherein said first and second types of carrier particles comprise a polymeric coating thereon and wherein said polymeric coating of said first type of carrier particles comprises poly(vinylidene fluoride), and said polymeric coating of said second type of carrier particles comprises poly(methyl methacrylate).

11. A mixture of carrier particles useful in electrographic developers comprising toners and carrier particles, said mixture comprises at least a first type of carrier particles and a second type of carrier particles, wherein said first type of carrier particles occupies a position in the triboelectric continuum different from the position in the triboelectric continuum occupied by said second type of carrier particles, said positions determined relative to said toner, and the level of charge to which said mixture of carrier particles charges said toner in a developer composition continuously decreases from a high level when said carrier mixture comprises all of said first type of carrier particles to a low level when said carrier mixture comprises all of said second type of carrier particles, and wherein at least said first and second types of carrier particles comprise cores having nonionic polymeric coatings, and wherein said first and said second types of carrier particles comprise hard ferrite, and said mixture of carrier particles is employed in combination with a magnetic applicator comprising a rotatable magnetic core and an outer non-magnetizable shell.

12. The mixture of carrier particles of claim 11, wherein said polymeric coatings comprise one or more polymers selected from the group consisting of silicones, cellulosic polymers, styrene polymers, acrylic polymers, fluoropolymers, vinyl polymers, polyesters and copolymers thereof.

13. The mixture of carrier particles of claim 11, wherein said polymeric coatings comprise one or more polymers selected from the group consisting of poly(methyl methacrylate), poly(vinylidene fluoride), vinylidene chloride-acrylonitrile copolymer, vinylidene chloride-acrylonitrile-acrylic acid terpolymer, cellulose nitrate chlorotrifluoroethylene vinylidene fluoride, diphenylene sulfone, epoxy/amine curing agent, cellulose acetate butyrate, acrylonitrile-butadiene-styrene terpolymer, chlorosulfonated polyethylene, polyethylene, polystyrene, ethyl cellulose, phenol formaldehyde, polyurethane, alkyl-substituted polyvinyl pyrrolidone, polyvinyl formal, poly-bisphenol-A-carbonate, alkyl-substituted polyvinyl pyrrolidone, diallyl phthalate, and styrene-butadiene block copolymer, styrene-isoprene block copolymer, and styrene-ethylene-propylene block copolymer.

14. The mixture of carrier particles of claim 11, wherein the absolute value of the difference between the triboelectric charge of said first type of said carrier particles and the triboelectric charge of said second type of carrier particles is at least 5 μC/g.

15. An electrographic developer, comprising toner particles and said mixture of carrier particles of claim 1.

16. The process of changing the toner charge in a developer comprising toner and a first type of carrier particles, comprising the steps of:

determining if the toner charge needs to be increased or decreased to obtain a desired toner charge; and adding a second type of carrier particles to said developer, said second type of carrier particles occupying a position in the triboelectric continuum different from the position in the triboelectric continuum occupied by said first type of carrier particles whereby the addition of said second type of carrier particles to said developer adjusts the toner charge to said desired toner charge, and wherein said first ann said second types of carrier particles comprise hard ferrite, and said mixture of carrier particles is employed in combination with a magnetic applicator comprising a rotatable magnetic core and an outer non-magnetizable shell.

17. The mixture of carrier particles of claim 1, where at least one type of carrier particles comprises gamma ferric oxide.

18. The mixture of carrier particles of claim 1, where at least one type of carrier particles comprises ferrite of barium, strontium, lead, magnesium, lanthanum or aluminum.

19. The mixture of carrier particles of claim 11, where at least one type of carrier particles comprises gamma ferric oxide.

20. The mixture of carrier particles of claim 11, where at least one type of carrier particles comprises ferrite of barium, strontium, lead, magnesium, lanthanum or aluminum.

* * * * *